United States Patent [19]

McCready et al.

[11] 4,386,121

[45] May 31, 1983

[54] SPRAY PROCESS FOR CHEMICAL NICKEL PLATING

[75] Inventors: Newton W. McCready, Newtown Square; Stephan S. Groffman, Philadelphia, both of Pa.

[73] Assignee: Amchem Products, Inc., Ambler, Pa.

[21] Appl. No.: 318,680

[22] Filed: Nov. 5, 1981

[51] Int. Cl.[3] ..... B05D 7/22; B05D 1/02; B05D 7/14; C23C 3/02

[52] U.S. Cl. ..... 427/235; 427/236; 427/331; 427/405; 427/427

[58] Field of Search ..... 427/235, 236, 331, 405, 427/427

[56] References Cited

U.S. PATENT DOCUMENTS

| | | | |
|---|---|---|---|
| 2,532,283 | 12/1950 | Brenner, et al. | 117/50 |
| 2,658,839 | 11/1953 | Talmey et al. | 117/102 |
| 2,658,841 | 11/1953 | Gutzeit et al. | 117/130 |
| 2,658,842 | 11/1953 | Gutzeit et al. | 117/130 |
| 2,694,019 | 11/1954 | Gutzeit | 117/130 |
| 2,762,723 | 9/1956 | Talmey et al. | 117/130 |
| 2,766,138 | 10/1956 | Talmey | 117/102 |
| 2,822,294 | 2/1958 | Gutzeit et al. | 117/130 |
| 2,837,445 | 6/1958 | Talmey et al. | 117/130 |
| 2,874,073 | 2/1959 | Metheny et al. | 117/130 |
| 2,999,770 | 9/1961 | Gutzeit | 117/130 |
| 3,709,715 | 1/1973 | Edmunds et al. | 427/235 |

*Primary Examiner*—James R. Hoffman

*Attorney, Agent, or Firm*—Ernest G. Szoke; Henry E. Millson, Jr.

[57] ABSTRACT

A spray process for plating nickel metal or ferrous metal surfaces using a solution containing nickel ions and hypophoshite ions.

15 Claims, No Drawings

SPRAY PROCESS FOR CHEMICAL NICKEL PLATING

BACKGROUND OF THE INVENTION

1. Field of the Invention

For many years tin plated steel cans were the containers of choice in the canning of comestibles, and in fact, are still in extensive use today. However, competition from the aluminum industry has resulted in the use of aluminum cans for the packaging of many foods and beverage products previously the domain of the tin plated steel can. The present economics favor the aluminum can, due to the high cost and periodic scarcity of tin.

Accordingly, a need has arisen for steel cans without a tin coating for use in the comestible industry. Chromium (chromium/chromium oxide) coated steel, which resists undercutting of the lacquer or other outer finishings when defects in the finishing are present cannot however be used in the formation of drawn and ironed cans using present manufacturing equipment. In addition, even if a process could be found to form such chromium coated steel cans, chromium is not too satisfactory a metal on which to apply a finishing coating such as paint or lacquer, since adhesion qualities are not good and decrease rapidly as the thickness of the chromium coating increases.

Drawn and ironed steel cans, usually referred to as "black-plate" cannot be used for comestibles since defects in the finishing coatings would permit rusting and attack on the steel by the contents of the can, rendering the food or beverage contaminated with the steel metal, resulting in a metallic taste and off-color, and in extreme cases resulting in eventual weakening or penetration of the walls of the can on extended storage. In addition, rusting of the clean cans prior to the application of the finishing coating cannot readily be controlled.

2. Description of the Prior Art

The plating of nickel metal on a variety of metals by chemical reduction methods is well known to the art. Examples of patents disclosing such chemical processes are given below:

| U.S. Pat. No. | Title | Issue Date |
|---|---|---|
| 2,532,283 | Nickel Plating by Chemical Reduction | December 5, 1950 |
| 2,658,839 | Process of Chemical Nickel Plating | November 10, 1953 |
| 2,658,841 | Process of Chemical Nickel Plating and Bath therefor | November 10, 1953 |
| 2,658,842 | Process of Chemical Nickel Plating and Bath therefor | November 10, 1953 |
| 2,694,019 | Processes of Chemical Nickel Plating and Baths therefor | November 9, 1954 |
| 2,762,723 | Processes of Chemical Nickel Plating and Baths therefor | September 11, 1956 |
| 2,766,138 | Processes of Chemical Nickel Plating | October 9, 1956 |
| 2,822,294 | Chemical Nickel Plating Processes and Baths therefor | February 4, 1958 |
| 2,837,445 | Continuous Processes of Chemical Nickel Plating | June 3, 1958 |
| 2,874,073 | Methods of Chemical Nickel Plating | February 17, 1959 |

-continued

| U.S. Pat. No. | Title | Issue Date |
|---|---|---|
| 2,999,770 | Process of Chemical Nickel Plating and Baths therefor | September 12, 1961 |

The above patents all describe various aqueous bath compositions containing, inter alia, a soluble nickel salt and an alkali metal hypophosphite, as well as methods for treating metal materials by immersing the metal materials in the baths.

Treatment times disclosed in the above patents range from about thirty minutes to six hours, with some plating tests being carried out in ten minutes or more.

DESCRIPTION OF THE INVENTION

A method has now been found to apply a nickel metal coating to drawn and ironed blackplate steel cans using commercially available spray equipment. This method can also be used with so-called "nickel-plate" steel cans, where a thin layer of nickel is plated onto the steel sheets to assist in the drawing and ironing process. However, the nickel layer is too thin and usually is discontinuous after the can is formed, so that little protection for the steel remains.

The process of the invention results in the formation of an excellent undercoating onto which finishing coatings such as lacquers can be applied. In addition to providing good lacquer adhesion characteristics, the nickel coating prevents or minimizes undercutting that would otherwise result at the loci of defects in the lacquer coating. Furthermore, the shiny appearance of the cans is retained. The resulting cans are therefore satisfactory for use with comestibles while at the same time being economically competitive with or cheaper than aluminum cans.

The process of the invention is carried out by first spraying clean drawn and ironed blackplate steel cans with an aqueous solution having the following compositions:

(a) from about 0.02 to about 0.13, preferably from about 0.02 to about 0.08 moles per liter of divalent nickel ion; and (b) from about 0.02 to about 0.19, preferably from about 0.03 to about 0.12 moles per liter of hypophosphite ion.

The nickel ions are present in the above composition in the form of a soluble nickel salt that does not inhibit plating of the nickel on the steel cans. For example, nickel chloride, nickel sulfate, nickel acetate, and nickel hypophosphate can be employed.

The hypophosphite ion is present as the nickel salt or as an alkali metal salt, e.g. as the sodium, potassium or lithium salt. The calcium or barium salts may also be used, provided the nickel salt is not nickel sulfate, which would result in the precipitation of insoluble calcium or barium sulfate. When nickel hypophosphite is employed, this salt will of course provide a source of both nickel ions and hypophosphite ions. If other than a 1:2 ratio between the nickel ion and the hypophosphite ion is desired in the solution, additional nickel ion or hypophosphite ion may be added separately in the form of another salt.

In addition to the above ingredients which are required in the aqueous solutions used in the process of the invention certain optional ingredients may also be present.

Optionally, but preferably, a sequestering agent is present in amount sufficient to give a ratio of sequestering groups to nickel ions of from about 1:1 to about 5:1, preferably about 2:1 to about 3:1. The sequestering agent acts to extend the bath life by complexing most of the nickel ions, thus minimizing precipitation of nickel metal and/or nickel phosphite. Nickel phosphite can form from the oxidation of the hypophosphite ions, which occurs during the plating process. The sequestering agents that can be used in the above aqueous solutions are those sequestering agents capable of sequestering nickel ions. Examples of such sequestering agents include weak organic acids and alkali metal and ammonium salts thereof, such as acetic acid, hydroxyacetic acid, citric acid, succinic acid, lactic acid, malic acid, propionic acid, adipic acid, sodium acetate, sodium hydroxyacetate, sodium citrate, potassium succinate; ammonium hydroxide; short chain aliphatic aminocarboxylic acids and salts thereof, such as glycine, α-alanine, β-alanine, α-aminobutyric acid, aspartic acid, iminodiacetic acid, iminotriacetic acid, and ethylenediaminotetraacetic acid; and sulfamic acid.

Many of the above sequestering agents also act as buffers in the solutions, helping to maintain the pH within the desired ranges described below.

The pH of the aqueous solution used in the practice of the invention should be in the range of about 3.0 to about 11.0, preferably from about 3.0 to about 6.0, and most preferably about 4.5 to 5.0. In order to obtain a pH within the preferred ranges, it may be necessary to adjust the pH with a pH regulator, i.e. using a controlled quantity of strong mineral acid or alkali metal hydroxide, e.g. hydrochloric acid, sulfuric acid, sodium hydroxide, etc.

Another optional ingredient that may be added is a so-called "exaltant" to accelerate the rate of deposition of nickel on the steel surfaces. Examples of such exaltants include succinic acid, fluoride anions, adipic acid, lactic acid, and the like. As can be seen from the examples given for sequestering agents above, lactic acid, succinic acid and adipic acid can perform a dual function of sequestration and exaltation. U.S. Pat. No. 2,658,842 and 2,694,019 disclose the use of such exaltants in plating baths.

Small quantities of one or more surfactants may be added to promote wetting of the surfaces of the steel cans. From about 0.01 to about 0.1 percent by weight of one or a combination of surfactants may be employed. Such surfactants are commercially available and are well known to the art. Examples of such surfactants include TRITON N-101 (Rohm & Haas Company), a nonyl phenoxy polyethoxyethanol containing about 9 ethoxy groups; and TERGITOL 15-S-9 (Union Carbide Corporation), a secondary alcohol polyethoxyethanol, wherein the secondary alcohol moiety contains 11 to 15 carbon atoms and the polyethoxyethanol moiety contains about 9 ethoxy groups.

Another optional ingredient that may be added to the aqueous solutions of the invention are small quantities of stabilizers, such as thiourea, sodium ethylxanthate, lead sulfide, and tin sulfide. Such stabilizers act to prevent decomposition of the solution by "masking" active nuclei.

The above aqueous solution is sprayed onto the surfaces of blackplate steel cans at a temperature in the range of from about 140° to about 190°, preferably from about 150° to about 160° F. Spray times are controlled by the nature of the commercial spray equipment used, and are generally in the range of 20 to 40 seconds, although spray times may range from 10 seconds to one minute, and such periods of time can also be used for the present process. Longer spray times can also be employed, but are generally beyond the capacity of the commercial spray equipment used to apply protective coatings to cans, and such longer times are not required to obtain the benefits of the present process.

Following the steps of spraying the blackplate steel cans with the aqueous solution of the invention, excess solution is promptly removed from the surfaces of the cans, preferably by spraying the cans with tap water. Optionally but preferably, the cans are then sprayed with deionized water. The cans are then dried, and a finishing coating applied such as by treatment with waterborne liners such as water based lacquers or enamels. After curing of the finishing coating the cans may be labelled, etc., and are suitable for filling with comestibles.

Prior to the step of spraying the blackplate steel cans with the aqueous solution of the invention, the surface of the can must be cleaned to remove dirt, metal fines, and lubricants used in the drawing and forming operation. Cleaners for this purpose are alkaline cleaners well known in the art. Examples of such cleaners useful on steel surfaces are given in Table 4, page 320 of Metals Handbook, 8th Edition, Volume 2, (1964), published by the American Society for Metals, Metals Park, Ohio, together with a disclosure of their methods of use on pages 321 and 322 of the above reference, and such disclosures are specifically incorporated herein by reference. Following the use of the alkaline cleaners, excess cleaner is removed from the cans by rinsing with tap water. The wet cans may then be used directly in the process of the invention.

The above spray process of the invention can be used in commercial spray equipment commonly used to apply conversion coatings to the surfaces of aluminum cans. The fact that a nickel coating can be applied to blackplate steel cans in a commercially useful manner using the spray process of the invention is surprising for a number of reasons including the following:

1. The hypophosphite ion is a strong reducing agent and it would be expected that a spray process would result in the rapid oxidation of the hypophosphite anion from oxygen in the air with which the spray comes into contact. In fact, no appreciable air oxidation of the hypophosphite ion was observed.
2. During the process of coating nickel onto the surfaces of the steel cans, relatively insoluble nickel phosphite is formed by the oxidation of the hypophosphite ion. While a sequestering agent may be added to complex most of the nickel ions to try to prevent precipitation of the nickel phosphite, it was not known whether or not the spray process would interfere with the sequestration and accelerate nickel phosphite precipitation, or cause heavy precipitation of nickel phosphite in the absence of a sequestering agent. If this occurred, clogging of the spray nozzles could result. While some precipitation of nickel phosphite was in fact observed, such precipitation was not extensive enough to clog the spray nozzles, even when no sequestering agent was employed.
3. Spray times used in commercial can spraying equipment are very short. As disclosed above, such spray times are normally in the range of 20 to 40 seconds. Since the prior art cited above showing bath conversion processes uses contact times upward of one hour, it was unexpected to find that commercially useful nickel coatings could be formed in a matter of seconds using a spray process.

4. The temperatures used in the present process are relatively low. Since the spray contact times are extremely short, it would have been expected that very high solution temperatures would be necessary to obtain any meaningful nickel coating. Such, however, was not found to be the case.
5. The concentrations of ingredients used in the solutions of the invention are relatively low; in fact, as low as or even lower than the concentrations of ingredients disclosed in the above cited prior art for the bath immersion process. Here again, since spray contact times are very short, it would be expected that only very concentrated solutions would have any prospect of working.

The invention will be better understood from the following examples which are given for illustration purposes only and are not meant to limit the invention.

EXAMPLE I

Two blackplate steel panels (4"×4") were cut from the sidewalls of a drawn and ironed blackplate steel can (U.S. Steel Company's CYCLITE can). The steel panels were spray cleaned with RIDOLINE 666, an alkaline cleaning solution for metals sold commercially by Amchem Products, Inc., and the excess cleaning solution rinsed off by dipping the panels in tap water.

The panels were then sprayed for 30 seconds with the following aqueous solution maintained at about 150° F.:

| Ingredients | Grams/Liter |
|---|---|
| $NiCl_2.6H_2O$ | 11.9 |
| $NaH_2PO_2.H_2O$ | 14.85 |
| $HOCH_2CO_2H$(70%) | 16.3 |

The above solution was adjusted to a pH of 5.0 with sodium hydroxide.

The panels were then rinsed by dipping them in tap water followed by spraying with deionized water.

The panels were dried in an oven at 200° C. for five minutes. The panels were removed from the oven and allowed to cool to room temperature.

One panel was placed in a humidity cabinet at 50.5° C. and 82% relative humidity for three days. The panel was then removed from the humidity cabinet and examined for discoloration which indicates whether or not any rusting took place and the qualitative degree of rusting that occurred. The results are given below together with the grading system used.

| Inside Surface | Outside Surface | Average |
|---|---|---|
| 4.5 | 4.7 | 4.6 |

Rating Chart:

5=no rusting
4=very slight rusting (less than 10% of the surface)
3=slight rusting (between 10% and 30% of the surface)
2=moderate rusting (between 30% and 50% of the surface)
1=severe rusting (between 50% and 90% of the surface)
0=completely rusted (over 90% of the surface)

The inside surface of the second panel was coated with Glidden Aqualure Water Base Interior Spray Liner #640C549A using a #22 draw bar. The coating was cured by placing the panel in an oven maintained at 400° F. for about 2 minutes.

The panel was then removed from the oven, allowed to cool, and the outside (convex) surface of the panel was protected by lacquering it with Scotch Clad Strip Coating No. 2253 and allowing it to air dry for 10 minutes. The edges of the panel were taped with Scotch Plastic Tape #471, ½" width. The panel was scribed on the inside (concave) surface using a Worcester C4 883 Armide scribe. The scribe line was centered on the panel perpendicular to the direction the can was drawn, with the scribe line stopping about ¼" from each taped edge. The panel was then placed in a rack and immersed in the following solution for four days at room temperature:

| Ingredients | Quantity |
|---|---|
| tap water | 18 liters |
| sodium chloride | 270 grams |
| citric acid monohydrate | 270 grams |

During the four day period the solution was stirred with a magnetic stirring bar. The panel was then removed from the above solution, rinsed with warm tap water and dried with a dry cloth. The panel was examined for undercutting from the scribe. No undercutting in fact occurred.

EXAMPLE II

Two blackplate steel panels of the same size and composition as those used in EXAMPLE I were treated according to the process of EXAMPLE I except that the panels were not sprayed with an aqueous solution containing the $NiCl_2.6H_2O$, $NaH_2PO_2.H_2O$ and $HOCH_2CO_2H$, i.e. the steel panels were not protected by a nickel coating. The results are shown below in tabular form:

| Humidity Cabinet Results | | | MM |
|---|---|---|---|
| Inside Surface | Outside Surface | Average | Undercutting* |
| 5 | 3 | 4 | 2.5 |

*Total of both sides of the scribe.

The above example was used as a control.

EXAMPLE III–XXII

The process of EXAMPLE I was repeated using pairs of steel panels of the same size and composition as those of EXAMPLE I except that the nickel coating solutions were those shown in Table I below. All coating solutions were adjusted to the pH shown using either NaOH or HCl. Also, the rusting and undercutting results are shown in tabular form for each such example.

TABLE I

| Example | COATING SOLUTION Ingredient | G/L | pH | HUMIDITY CABINET Inside Surface | Outside Surface | Av. | MM Undercutting* |
|---|---|---|---|---|---|---|---|
| III | $NiCl_2.6H_2O$ | 10.7 | 4.51 | 4.9 | 3.5 | 4.2 | None |
| | $NaH_2PO_2.H_2O$ | 11.9 | | | | | |
| | $CH_3CO_2Na.3H_2O$ | 12.25 | | | | | |
| IV | $NiCl_2.6H_2O$ | 7.15 | 4.49 | 4.9 | 3.5 | 4.2 | None |
| | $NaH_2PO_2.H_2O$ | 11.9 | | | | | |
| | $CH_3CO_2Na.3H_2O$ | 8.15 | | | | | |
| V | $NiCl_2.6H_2O$ | 9.1 | 4.50 | 4.9 | 4.7 | 4.8 | None |
| | $NaH_2PO_2.H_2O$ | 11.9 | | | | | |
| | $(CH_2CO_2Na)_2.6H_2O$ | 7.45 | | | | | |
| VI | $NiCl_2.6H_2O$ | 9.15 | 4.50 | 4.9 | 4.7 | 4.8 | None |
| | $NaH_2PO_2.H_2O$ | 6.5 | | | | | |
| | $(CH_2CO_2Na)_2.6H_2O$ | 10.15 | | | | | |
| VII | $NiCl_2.6H_2O$ | 11.2 | 4.47 | 4.9 | 4.5 | 4.7 | None |
| | $NaH_2PO_2.H_2O$ | 15.0 | | | | | |
| | $(CH_2CO_2Na)_2.6H_2O$ | 7.45 | | | | | |
| VIII | $NiCl_2.6H_2O$ | 7.7 | 4.50 | 4.9 | 4.9 | 4.9 | None |
| | $NaH_2PO_2.H_2O$ | 7.95 | | | | | |
| | $(CH_2CO_2Na)_2.6H_2O$ | 8.7 | | | | | |
| IX | $NiCl_2.6H_2O$ | 7.7 | 4.50 | 4.9 | 4.7 | 4.8 | None |
| | $NaH_2PO_2.H_2O$ | 7.95 | | | | | |
| | $(CH_2CO_2Na)_2.6H_2O$ | 8.7 | | | | | |
| | SURFONIC LF-17 | 0.5 | | | | | |
| X | $NiCl_2.6H_2O$ | 20 | 5.0 | 4.0 | 4.0 | 4.0 | None |
| | $NaH_2PO_2.H_2O$ | 6.6 | | | | | |
| | $CH_3CO_2Na.3H_2O$ | 3.8 | | | | | |
| XI | $NiCl_2.6H_2O$ | 5.5 | 4.5 | 5.0 | 3.5 | 4.3 | 0.3 |
| | $NaH_2PO_2.H_2O$ | 3.0 | | | | | |
| | $CH_3CH_2CO_2H$ | 0.8 | | | | | |
| | $CH_3CHOHCO_2H$(85%) | 0.1 | | | | | |
| XII | $NiCl_2.6H_2O$ | 5.5 | 4.5 | 4.5 | 3.5 | 4.0 | None |
| | $NaH_2PO_2.H_2O$ | 3.0 | | | | | |
| | $CH_3CO_2Na.3H_2O$ | 5.7 | | | | | |
| XIII | $NiCl_2.6H_2O$ | 5.5 | 4.5 | 4.5 | 3.0 | 3.8 | 0.5 |
| | $NaH_2PO_2.H_2O$ | 3.0 | | | | | |
| | $CH_3CO_2Na.3H_2O$ | 5.7 | | | | | |
| | TERGITOL 15-S-9 | 1.0 | | | | | |
| XIV | $NiCl_2.6H_2O$ | 5.5 | 4.5 | 4.5 | 3.0 | 3.8 | 0.1 |
| | $NaH_2PO_2.H_2O$ | 3.0 | | | | | |
| | $CH_3CO_2Na.3H_2O$ | 5.7 | | | | | |
| | TRITON N-101 | 1.0 | | | | | |
| XV | $NiCl_2.6H_2O$ | 5.5 | 4.5 | 4.5 | 3.0 | 3.8 | 0.1 |
| | $NaH_2PO_2.H_2O$ | 3.0 | | | | | |
| | $CH_3CO_2Na.3H_2O$ | 5.7 | | | | | |
| | TRITON N-100 | 1.0 | | | | | |
| XVI | $NiCl_2.6H_2O$ | 5.5 | 4.5 | 5.0 | 3.5 | 4.3 | 0.8 |
| | $NaH_2PO_2.H_2O$ | 3.0 | | | | | |
| | $(CH_2CO_2Na)_2.6H_2O$ | 5.7 | | | | | |
| | $HO_2CCHOHCH_2CO_2H$ | 5.6 | | | | | |
| XVII | $NiCl_2.6H_2O$ | 5.5 | 4.5 | 4.5 | 3.0 | 3.8 | 0.5 |
| | $NaH_2PO_2.H_2O$ | 3.0 | | | | | |
| | $NH_2CH_2CO_2H$ | 1.6 | | | | | |
| | $HO_2CCHOHCH_2CO_2H$ | 5.6 | | | | | |
| XVIII | $NiCl_2.6H_2O$ | 5.5 | 4.5 | 5.0 | 3.5 | 4.3 | 0.3 |
| | $NaH_2PO_2.H_2O$ | 3.0 | | | | | |
| | $HO_2C(CH_2)_4CO_2H$ | 3.1 | | | | | |
| XIX | $NiCl_2.6H_2O$ | 5.5 | 4.5 | 4.5 | 3.5 | 4.0 | 0.4 |
| | $NaH_2PO_2.H_2O$ | 3.0 | | | | | |
| | $(CH_2CO_2Na)_2.6H_2O$ | 5.7 | | | | | |
| XX | $NiCl_2.6H_2O$ | 5.5 | 4.5 | 5.0 | 4.5 | 4.8 | 0.3 |
| | $NaH_2PO_2.H_2O$ | 3.0 | | | | | |
| | $NH_2CH_2CO_2H$ | 1.6 | | | | | |
| XXI | $NiCl_2.6H_2O$ | 5.5 | 4.5 | 4.5 | 3.5 | 4.0 | 0.7 |
| | $NaH_2PO_2.H_2O$ | 3.0 | | | | | |
| | $H_2NCH(CH_3)CO_2H$ | 1.9 | | | | | |
| XXII | $NiCl_2.6H_2O$ | 5.5 | 4.5 | 4.5 | 1.0 | 2.8 | None |
| | $NaH_2PO_2.H_2O$ | 3.0 | | | | | |
| | NaF | 4.2 | | | | | |

*Total of both sides of the scribe.

What is claimed is:

1. A process for applying a nickel metal coating to a clean ferrous metal can comprising the steps of:

(a) forming an aqueous solution comprising (i) from about 0.02 to about 0.13 moles per liter of divalent nickel ion, and (ii) from about 0.02 to about 0.19 moles per liter of hypophosphite ion;

(b) heating said aqueous solution to a temperature in the range of from about 140° to about 190° F.;

(c) spraying the surfaces of the ferrous metal can with said heated aqueous solution for a period of from about 10 seconds to about 1 minute; and (d) removing excess aqueous solution from the surfaces of the ferrous metal can.

2. The process of claim 1 wherein the clean ferrous metal can treated by said process already contains a thin nickel coating thereon.

3. The process of claim 1 wherein the divalent nickel ion is present in from about 0.02 to about 0.08 moles per liter.

4. The process of claim 1 wherein the hypophosphite ion is present in from about 0.03 to about 0.12 moles per liter.

5. The process of claim 1 wherein the aqueous solution also contains a small quantity of surfactant.

6. The process of claim 1 wherein the aqueous solution also contains an exaltant to increase the rate of formation of the nickel metal coating.

7. The process of claim 1 wherein the aqueous solution also contains an acidic or basic substance in quantity sufficient to bring the pH of the aqueous solution to a desired number within the range of from about 3.0 to about 11.0.

8. The process of claim 7 wherein the substance is present in quantity sufficient to bring the pH of the aqueous solution to a desired number within the range of from about 3.0 to about 6.0.

9. The process of claim 1 wherein the aqueous solution is sprayed onto the ferrous metal can at a temperature in the range of from about 150° to about 160° F.

10. The process of claim 1 wherein the spray time in step (c) is from about 20 seconds to about 40 seconds.

11. The process of claim 1 wherein in step (d) the excess aqueous solution is removed by rinsing with water.

12. The process of claim 1, 2, 3, 4, 5, 6, 7, 8, 9, 10, or 11, wherein the ferrous metal can is a drawn and ironed steel can or a nickel-plate steel can.

13. The process of claim 1, 2, 3, 4, 5, 6, 7, 8, 9, 10, or 11 wherein the aqueous solution also contains a sequestering agent present in amount sufficient to give a ratio of sequestering groups to nickel ions of from about 1:1 to about 5:1.

14. The process of claim 13 wherein said ratio is from about 2:1 to about 3:1.

15. The process of claim 13 wherein the ferrous metal can is a drawn and ironed steel can or a nickel-plate steel can.

* * * * *